US006404896B1

(12) United States Patent
Yoo et al.

(10) Patent No.: US 6,404,896 B1
(45) Date of Patent: Jun. 11, 2002

(54) ELECTRIC-ACOUSTIC TRANSDUCER HAVING DUAL VOICE COIL DRIVERS

(75) Inventors: Dong Ok Yoo, Kyungki-do; Kyung Ho Kim, Seoul, both of (KR)

(73) Assignee: Microtech Corporation, Kyungki-do (KR)

( * ) Notice: Subject to any disclaimer, the term of this patent is extended or adjusted under 35 U.S.C. 154(b) by 0 days.

(21) Appl. No.: 09/576,608

(22) Filed: May 24, 2000

(30) Foreign Application Priority Data

Jul. 30, 1999 (KR) ..... 99-31342

(51) Int. Cl.[7] ..... H04R 25/00
(52) U.S. Cl. ..... 381/401; 381/421; 381/431
(58) Field of Search ..... 381/302, 152, 381/182, 401, 407, 423, 431, FOR 155, FOR 159, FOR 161, FOR 163

(56) References Cited

U.S. PATENT DOCUMENTS 5,862,242 A * 1/1999 Takewa et al. ..... 381/398
6,285,773 B1 * 9/2001 Carme et al. ..... 381/398
6,341,167 B1 * 1/2002 Okuyama et al. ..... 381/407

* cited by examiner

*Primary Examiner*—Huyen Le
*Assistant Examiner*—Suhan Ni
(74) *Attorney, Agent, or Firm*—Rosenberg, Klein & Lee

(57) ABSTRACT

In the electric-acoustic transducer, first to third permanent magnets are respectively received in the first to the third recesses of a yoke, so as to generate non-alternating magnetic fields. The first and second magnetic gaps are formed between the yoke and the first and the second plates. The first and the second coils are respectively disposed in the first and the second magnetic gaps, to generate alternating magnetic fields of the same phase, when an electric driving signal is applied from the exterior. The electric-acoustic transducer achieves reproduction of a broad frequency band with high power and high efficiency, even with an ultra slim or small dimension, proper for a small electronic appliance such as a notebook computer, by employing dual voice coil drivers and auxiliary magnetic circuits.

12 Claims, 18 Drawing Sheets

ELECTRIC-ACOUSTIC TRANSDUCER HAVING DUAL VOICE COIL DRIVERS

BACKGROUND OF THE INVENTION

1. Field of the Invention

The present invention relates to an electric-acoustic transducer having dual voice coil drivers, and more particularly to an improved electric-acoustic transducer, which can achieve a reproduction of a broad frequency band with high power and high efficiency, even with an ultra slim or small dimension, proper for small electronic appliances such as a notebook computer, by employing dual voice coil drivers and auxiliary magnetic circuits.

2. Description of the Related Art

In general, a sound reproducer is classified into a horn speaker, a system speaker used in an audio-system of high-fidelity such as a component system and including a woofer, a midrange and a tweeter respectively covering a predetermined frequency band, a general speaker covering the entire frequency band by a single unit, a micro-speaker having an ultra-light and ultra-slim construction to be used in a micro-camcorder, a walkman, etc., a receiver used in a mobile communication terminal, an ear-phone having a construction partly inserted in a user's ear, and a buzzer receiving only a specific frequency band.

In a conventional general speaker, a bobbin around which a voice coil is wound is placed in a magnetic gap of a magnetic circuit which comprises a single magnet disposed in a yoke and a top plate mounted on the magnet. Further, the top of the bobbin is fixed to a vibrating diaphragm with a damper, whose center is perforated in a circular shape and whose periphery is fixed to upper and lower portions of the frame. A center cap or a dust cap is assembled at the center of the vibrating diaphragm to cover the center hole of the bobbin.

In the meantime, a micro-speaker employed in a cellular phone, a camcorder, a notebook computer, a micro-cassette, etc., has an electrodynamic construction in which the height of the frame is lowered by omitting the damper, so as to achieve ultra slim and ultra small construction corresponding to the size decrease of the system employing the micro-speaker.

In such an electrodynamic speaker, as shown in FIG. 1*a*, a protector 1 covers over a frame having a configuration of a recess, and a terminal plate 9 is fixed to the rear surface of the bottom of the frame 2. A magnetic circuit is formed by a yoke 8 fixed to a middle portion of the bottom of the frame, and a fixed magnet 6 and a plate 7 fixed in the yoke 8. The edge of the vibrational diaphragm 3 is so fixed to the stepped portion of the frame 2 that a moving coil 5 fixed to the vibrational diaphragm 3 is movably placed in the air gap between the yoke 8 and the plate 7. In FIG. 1*a*, numerals 10 and 11 respectively designate a hole and a coil.

The electrodynamic type speaker as above is of a structure in which the attraction and repulsion caused due to a reaction of a non-alternating (a direct current) magnetic flux generated in a fixed magnetic circuit upon an alternating (an alternating current) rotation magnetic flux generated in a moving coil movable in an upward and downward direction vibrate both the vibrational diaphragm and the moving coil upwardly and downwardly to produce sound. That is, the electrodynamic type speaker is a speaker in which the permanent magnet is fixed and the moving coil is moved, so that sound is generated.

However, the electrodynamic type speaker shown in FIG. 1*a* has disadvantages that in the case where it is manufactured in a micro form in order to apply to a notebook computer, a mini-cassette tape player, and a mobile communication terminal, etc., it is impossible to reproduce an expansion of the ranges of a low-pitched sound and a high-pitched sound necessary for portable electronic appliances in terms of a structure of a speaker.

Furthermore, although a coil wire 11 for supplying electric energy to the moving coil 5 vibrating upwardly and downwardly is fixed by applying a firm adhesive on the opposite ends thereof and a soft adhesive on the middle portion thereof as shown in FIGS. 1*a* and 1*b*, a breaking of the coil may happen when an excessive input is applied.

Moreover, especially when the vertical height of the speaker is not more than four millimeters, it is disadvantageous in working efficiency due to the construction to connect the flexible wire and the coil 5 with the top of the bobbin on which the coil shorter than the above four millimeters is wound. In this case, the breaking of the coil happens when the vertical height fails to accommodate the width of the vibration of the coil at a high input.

In the case that the input is limited in consideration of the danger of the coil breaking, it is impossible to achieve a high output. Moreover, it is difficult to secure a sufficient space for the vertical vibration for the high output in the speaker.

For reference, in a micro-speaker currently on the market, a rated input of a product is 0.01 (W) to 0.1 (W) when its diameter is less than 20 mm, 0.2 (W) to 0.5 (W) when its diameter is 36 mm, and 0.5 (W) to 1 (W) when 50 to 57 mm.

In the meantime, an appliance such as a notebook computer having a display monitor employs a slim-type speaker mounted near the screen or in a housing of a personal computer. This type of speaker has an oval construction whose dimensions are in a range from 28 by 40 mm to 16 by 35 mm as its minimum. In the case of the speaker having the dimensions of 16 by 35 mm, it exhibits a reproduction band of 480 Hz to 16 KHz when the minimum height is 4.5 mm, and an output of 73 dB under 1 M/1 W.

As the decrease of the dimensions of the speaker which produces a variety of restrictions, the low band resonance frequency $f_0$ is increased, and the efficiency and the output are decreased.

Meanwhile, in a practical use, the electrodynamic speaker based on the conventional electric-acoustic transducing principle is now utilized as a buzzer capable of reproducing only a single tone signal of a highly narrow one or two KHz.

Owing to the above reasons, there is a need in the art for a micro-speaker that can reproduce a sound of a broad band, receive a high input, and can be automatically embedded in a PCB of a set in all directions of 360 degrees without a soldering process in order to realize a multipurpose mini personal information processing terminal in the near future.

There is required a micro-speaker having the following characteristics and dimensions as a terminal for processing information: a reproduction frequency band of 200 Hz to 16 KHz; a longer axis of 13 mm, a shorter axis of 50 mm, and a height of 4.1 mm; a rated power of two watt; an output sound pressure level of 80 dB at a distance of one meter by an input of one watt; and a good assembling characteristic without using assembling screws.

SUMMARY OF THE INVENTION

Accordingly, the present invention has been made in an effort to solve the problems occurring in the related art, and an object of the present invention is to provide an improved electric-acoustic transducer, which can achieve a reproduction characteristic of a broad frequency band with high power and high efficiency, even with ultra slim or small dimensions, proper for a small electronic appliance such as a notebook computer, by employing dual voice coil drivers and auxiliary magnetic circuits.

Another object of the invention is to provide an improved micro-speaker including a plurality of voice coil drivers which enable a high power and a high efficiency and prevent unbalanced vibrations which may happen due to the longer axis of the single driver of the prior art, thereby realizing a clear and clean reproduction of high quality sound.

It is still another object of the invention to provide an improved micro-speaker which has a function of a broad band frequency reproduction capable of performing functions of various portable electronic appliances such as a buzzer, a receiver, a micro-speaker, etc., by a single unit of mini-size.

It is still another object of the invention to provide an improved micro-speaker, in which not only the above-mentioned functions are implemented but automatic mounting/coupling of the speaker is enabled to make the automation of its manufacturing process easier.

In accordance with one aspect, the present invention provides an electric-acoustic transducer comprising:

a yoke having first to third recesses arranged in series at regular intervals;

first to third permanent magnets respectively received in the first to the third recesses, the first to the third permanent magnets being arranged in a same polar direction to generate non-alternating magnetic fields;

first and second plates respectively mounted on the first and the third permanent magnets to form first and second magnetic gaps between an upper end of the yoke and outer peripheries of the first and the second plates;

first and second coils respectively disposed in the first and the second magnetic gaps, the first and the second coils generating alternating magnetic fields of a same phase and being displaced up and down according to a cooperation with the non-alternating magnetic fields generated by the first to the third permanent magnets when an electric driving signal is applied from exterior;

a rectangular frame having a periphery extending at a right angle to a remaining portion of the frame to form a recess, the yoke being placed at a center of the frame and surrounded by the periphery; and a vibrational diaphragm having a periphery supported by an upper end of the frame, the first and the second coils being attached to the vibrational diaphragm so that the vibrational diaphragm generates sound corresponding to the electric driving signal when the first and the second coils are displaced up and down.

The yoke for forming the first and the second magnetic gaps, the first and the third permanent magnets, and the first and the second plates form first and second magnetic circuits respectively for driving the first and the second coils, and the non-alternating magnetic flux generated from the second permanent magnet is added to non-alternating magnetic fluxes of the adjacent first and the second magnetic circuits. Therefore, the transducing efficiency is increased.

The frame further may comprise:

first and second penetrating spaces formed at both sides out of the yoke and communicating with an interior of the recess of the frame;

first and second guide means for forming first and second redundant leads in zigzag shapes, the first and the second redundant leads being drawn out through the first and the second penetrating spaces from the first and the second coils;

electrode terminals, through which the driving signal is applied from an exterior, having first to fourth electrode pads printed on a lower surface of the frame at both sides of the first and the second penetrating spaces, the first and the second redundant leads having opposite ends connected to the first to the fourth electrode pads, the first and the second electrode pads at a first side of the frame being connected to the third and the fourth electrode pads at a second side of the frame to thereby connect the first and the second coils in parallel to each other; and soft molding materials filled in the first and the second penetrating spaces with surrounding the first and the second redundant leads, thereby preventing the first and the second redundant leads from breaking.

In this case, the first and the second guide means are eliminated after the first and the second redundant leads are fixedly connected to the first to the fourth electrode pads.

The vibrational diaphragm may include a body having a shape of a rectangular plate and an edge for fixing the body to the frame.

In addition, the vibrational diaphragm may comprise:

first and second portions extending laterally in cone shapes from the first and the second necks to which the first and the second coils are attached;

third to fifth portions respectively forming a dome shape in first to third dust caps, the first and the second dust caps being disposed in the first and the second necks, the third dust cap being placed on a second recess between the first and the second necks;

a sixth portion forming a plane surface between the first and the second necks;

a seventh portion for preventing a divisional resonance of the vibrational diaphragm at a range of middle and high pitch tones, the seventh portion discontinuously protruding with a constant width and a constant height along a center portion of the first to the sixth portions excepting a central portion of the first to the third dust caps; and an edge formed integrally with the first to seventh portions, a body including the first to the second portions being supported by the frame.

Preferably, the electric-acoustic transducer may further comprise a reinforcing body for reducing nonlinear distortion of the vibrational diaphragm, the reinforcing body having a shape equal to a shape formed by the first to the sixth portions and being attached to a lower surface of the vibrational diaphragm, the reinforcing body having openings corresponding to center portions of the first to the third dust caps.

It is preferred that a plurality of pores are formed at a bottom of the frame to provide passages of sound and heat.

The electric-acoustic transducer of the invention may further include first to fourth engaging grooves respectively formed at the four corners of the lower surface of the frame, each of which is assembled by snap engagement with each of first to fourth snap engagement protuberances formed at a casing accommodating the speaker.

According to another aspect of the invention, provided is an electric-acoustic transducer comprising:

first and second yokes being spaced apart and respectively having first and second recesses;

first and second permanent magnets respectively received in the first and the second recesses, the first and the second permanent magnets being arranged in a same polar direction to generate non-alternating magnetic fields;

first and second plates respectively mounted on the first and the second permanent magnets to form first and second magnetic gaps between an upper end of the yoke and outer peripheries of the first and the second plates;

first and second coils respectively disposed in the first and the second magnetic gaps, the first and the second coils generating alternating magnetic fields of a same phase and being displaced up and down according to a cooperation with the non-alternating magnetic fields generated by the first and the second permanent magnets when an electric driving signal is applied from an exterior;

a rectangular frame having a periphery extending at a right angle to a remaining portion of the frame to form a recess, the first and the second yokes being placed at spaced two middle positions of the frame and surrounded by the periphery; and a vibrational diaphragm having a periphery supported by an upper end of the frame, the first and the second coils being attached to the vibrational diaphragm so that the vibrational diaphragm generates sound corresponding to the electric driving signal when the first and the second coils are displaced up and down.

The first and the second coils are connected to each other in series or in parallel, and the latter is preferable in consideration of matching impedance.

According to another aspect of the invention, provided also is an electric-acoustic transducer comprising:

a yoke having first to third recesses arranged in series at regular intervals;

first to third permanent magnets respectively received in the first to the third recesses, the first to the third permanent magnets being arranged in a same polar direction to generate non-alternating magnetic fields;

a plate mounted on the second permanent magnet to form a magnetic gap between an upper end of the yoke and outer periphery of the plate;

a coil disposed in the magnetic gaps, the coil generating an alternating magnetic field and being displaced up and down according to a cooperation with the non-alternating magnetic field generated by the second permanent magnet when an electric driving signal is applied from an exterior;

a rectangular frame having a periphery extending at a right angle to a remaining portion of the frame to form a recess, the yoke being placed at a center of the frame and surrounded by the periphery; and a vibrational diaphragm having a periphery supported by an upper end of the frame, the coil being attached to the vibrational diaphragm so that the vibrational diaphragm generates sound corresponding to the electric driving signal when the coil is displaced up and down.

In this case, the yoke for forming the magnetic gap, the second permanent magnet, and the plate form a first magnetic circuit for driving the coil, and the non-alternating magnetic fluxes generated from the first and the third permanent magnets are added to a non-alternating magnetic flux of the first magnetic circuit.

As described above, the present invention provides a speaker especially suitable for ultra small or ultra slim type products.

In the present invention, the increase of weight of the vibrating system due to the dual coil construction lowers the low pitch resonance frequency, thereby achieving capability of reproducing a wide band of frequency incorporating all the functions of various portable electronic appliances such as a buzzer, a receiver, a micro-speaker, etc.

Further, in the present invention, since the coils can be connected to the electrode terminals without using flexible wires, the risk of the coil breaking is eliminated. Also, a high input can be received due to the dual drivers and the auxiliary magnetic circuits, so that a characteristic of a high output and a high efficiency is achieved. Moreover, an automatic assembling or Counting of the speaker is possible without soldering by a snap engagement.

Therefore, the present invention precipitates realization of a portable data-processing terminal having multi-functions including visual, auditory, office working functions, etc.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Preferred embodiments of the present invention will be described in detail hereinafter with reference to the accompanying drawings.

A. First Embodiment

Figure 1A:
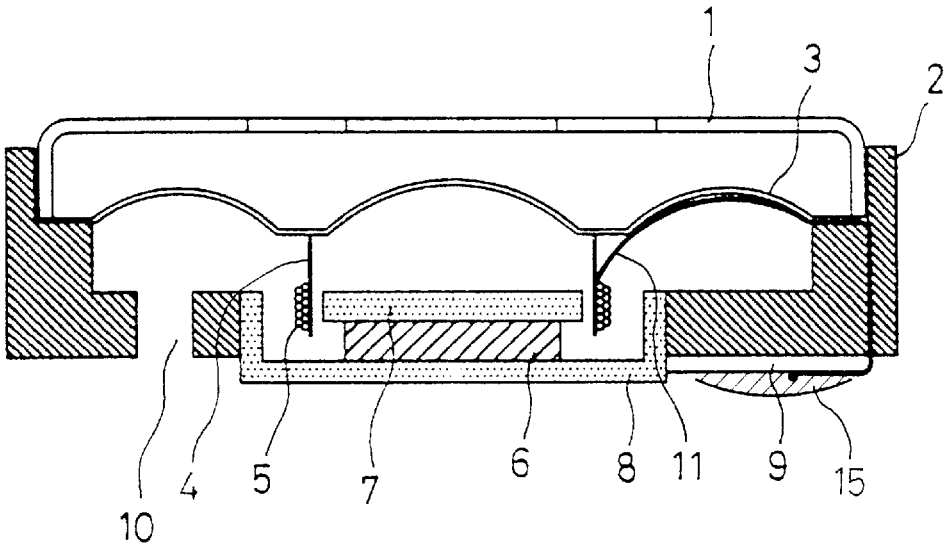
Fig. 1a (PRIOR ART)
FIG. 1*a* is a sectional view illustrating a conventional electro-dynamic type speaker.
Figure 1B:
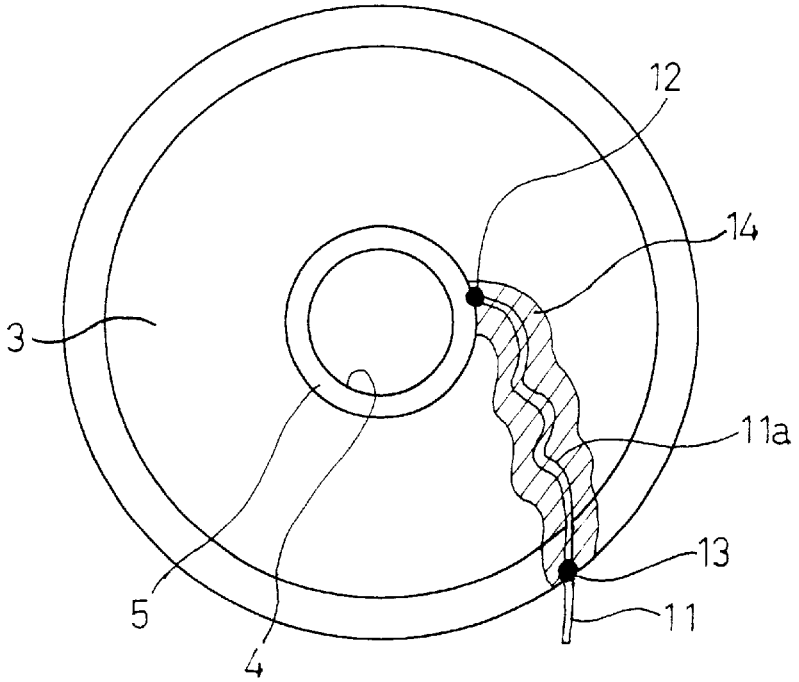
Fig. 1b (PRIOR ART)
FIG. 1*b* is a rear view of a vibrational diaphragm which shows a construction for fixing the coil of FIG. 1*a;*
Figure 2A:
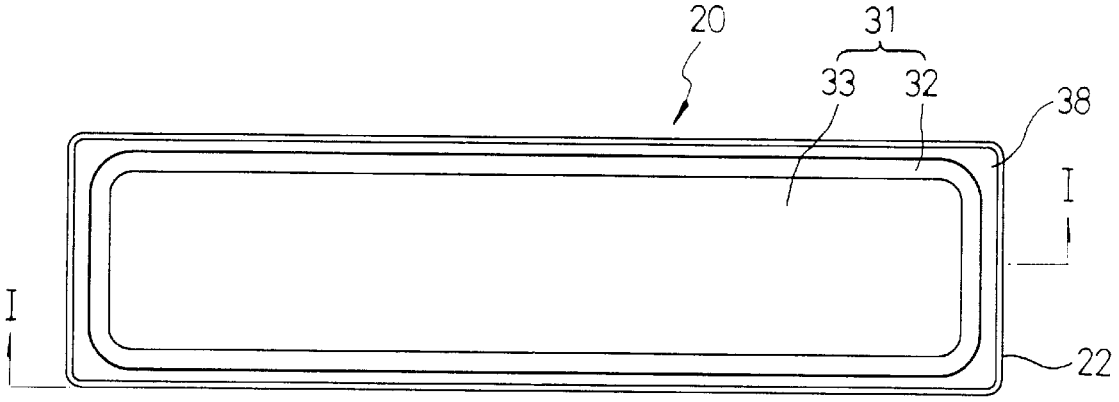
FIG. 2*a* is a plan view of an oval-type mini-speaker having dual sound-source constructions or dual voice coil drivers according to the first embodiment of the present invention.
Figure 2B:
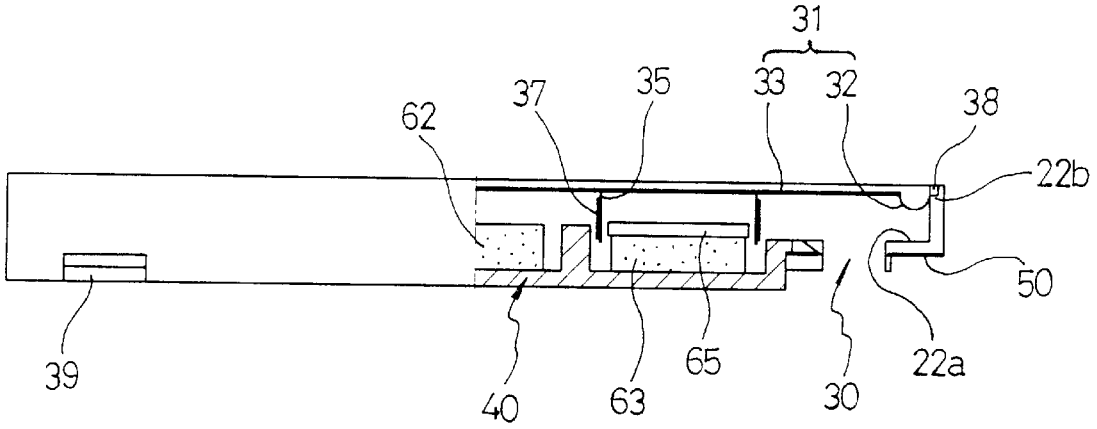
FIG. 2*b* is a sectional view along the line I—I in FIG. 2*a;*
Figure 2C:
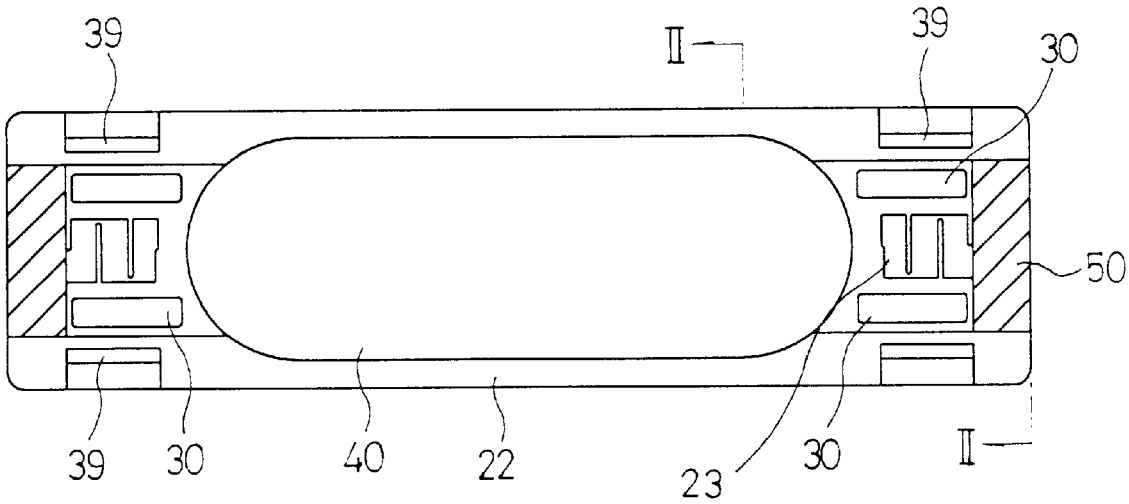
FIG. 2*c* is a bottom view of the oval-type mini-speaker shown in FIG. 2*a;*
Figure 2D:
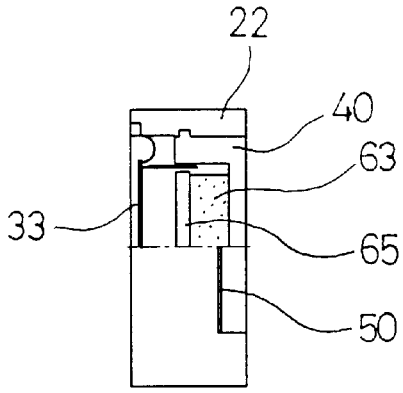
FIG. 2*d* is a sectional view along the line II—II in FIG. 2*c;*
Figure 3A:
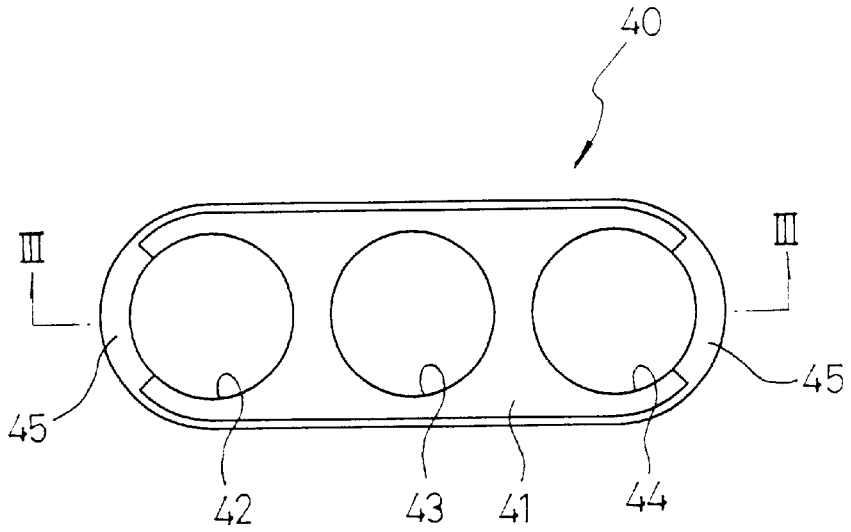
FIG. 3*a* is a plan view of a yoke employed in the mini-speaker shown in FIG. 2*a;*
Figure 3B:
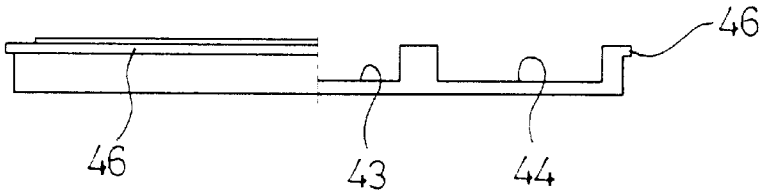
FIG. 3*b* is a sectional view along the line III—III in FIG. 3*a;*
Figure 3C:
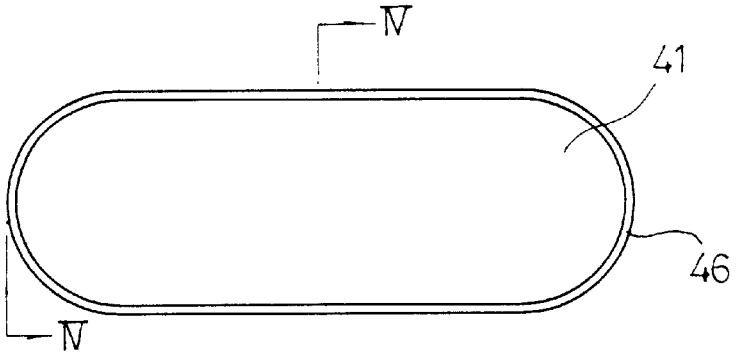
FIG. 3*c* is a bottom view of the yoke shown in FIG. 3*a;*
Figure 3D:
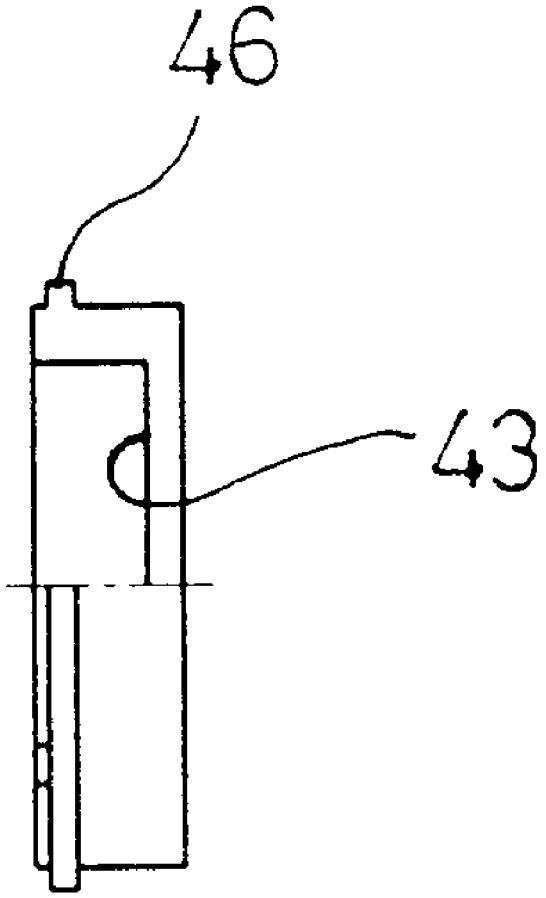
FIG. 3*d* is a sectional view along the line IV—IV in FIG. 3*c;*
Figure 4:
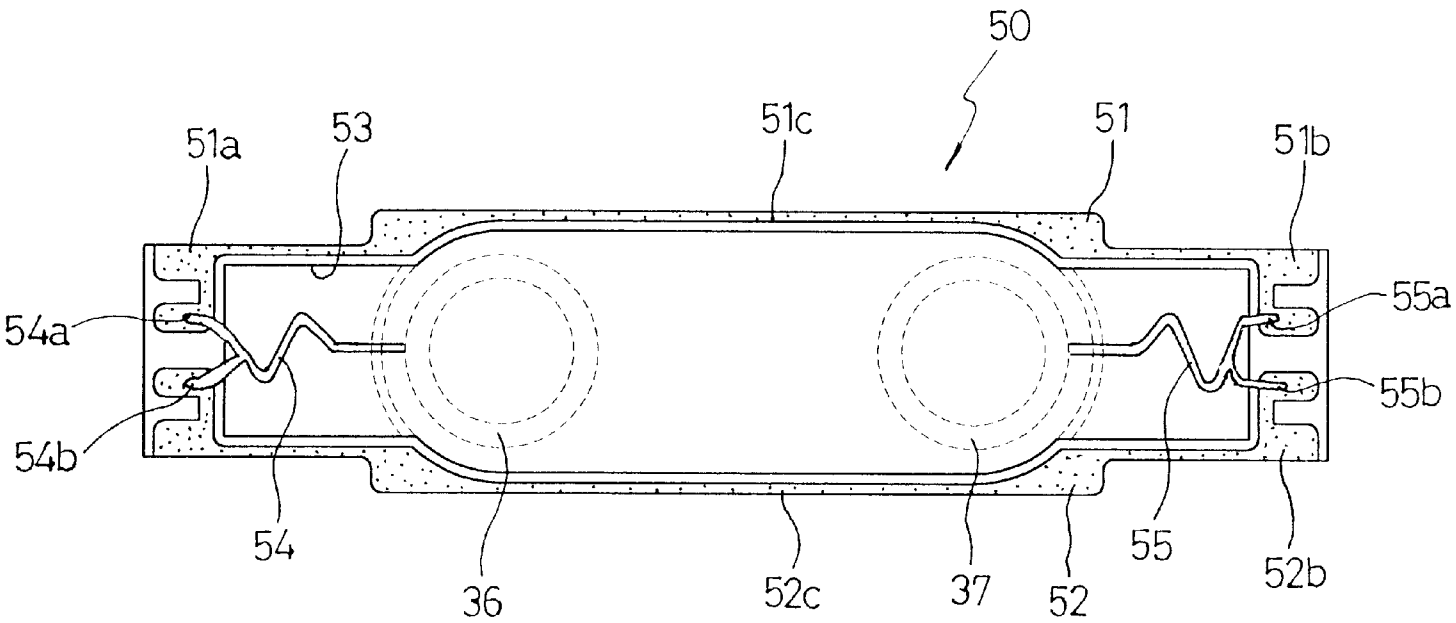
FIG. 4 is a plan view of a printed circuit board employed in the mini-speaker according to the first embodiment.

FIGS. 2*a* to 2*d* show an oval-type mini-speaker having dual sound-source constructions or dual voice coil drivers according to the first embodiment of the present invention, FIGS. 3*a* to 3*d* show a yoke employed in the mini-speaker, and FIG. 4 shows a printed circuit board (PCB) employed in the mini-speaker.

Referring to FIGS. 2*a* to 2*d* and FIG. 3, the oval-type mini-speaker 20 according to the first embodiment of the present invention includes a frame 22 having a shape of a rectangular box which contains a concave space and has a stepped portion 22*b* formed at an inner side wall thereof. The front surface (the upper surface) of the frame 22 is open, and a plurality of holes 30 for ensuring smooth vibration of a vibrational diaphragm 31 are formed at left and right sides of the bottom 22*a* of the frame 22. At each of the four corners of the rear surface (the lower surface) of the frame 22 is formed each of four engaging grooves 39 which are assembled by snap engagement with each of four snap engagement protuberances formed at a casing accommodating the speaker.

Figure 5:
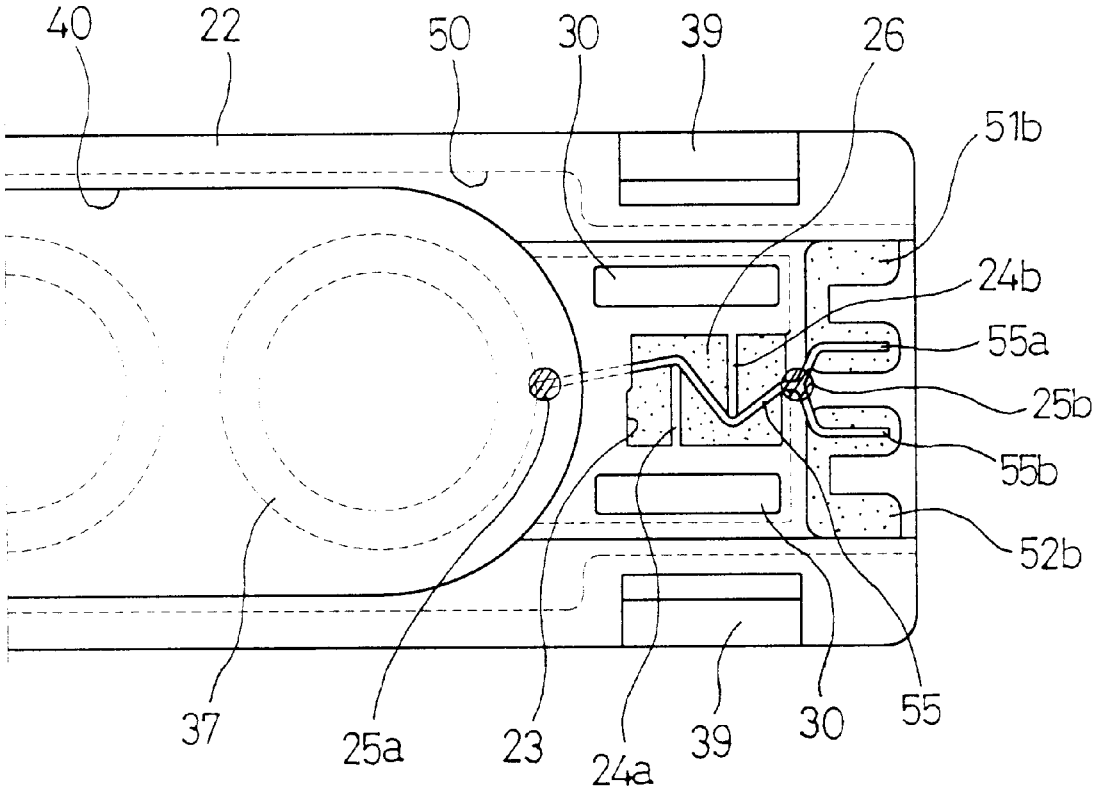
FIG. 5 is a plan view for showing a construction for fixing the coil according to the first embodiment.

The bottom 22*a* of the frame 22 is integrally formed into the shape as shown in FIG. 5 by an insert injection molding in a state that the oval yoke 40 shown in FIG. 3 is mounted on the PCB 50 shown in FIG. 4.

The yoke 40 has three circular recesses 42 to 44 formed in an oval body 41 of the yoke 40, and stepped portions 45, each having a height between 0.3 and 0.5 mm, formed at right and left sides of the recesses 42. In this construction, each of redundant leads 54*a*, 54*b*, 55*a*, and 55*b* of coils 36 and 37 can be easily passed through in lateral direction to be connected to electrode patterns 51 and 52 exposed at either side of the rear surface of the frame 22. Moreover, increased is the limit of vertical width in which the coil can vibrate. Therefore, this construction eliminates the necessity for using a separate flexible wire as that in the conventional way.

Meanwhile, a guide 46 formed at the periphery of the body 41 prevents the yoke 40 from shaking when the frame 22 is formed by an insert injection molding.

Figure 6:
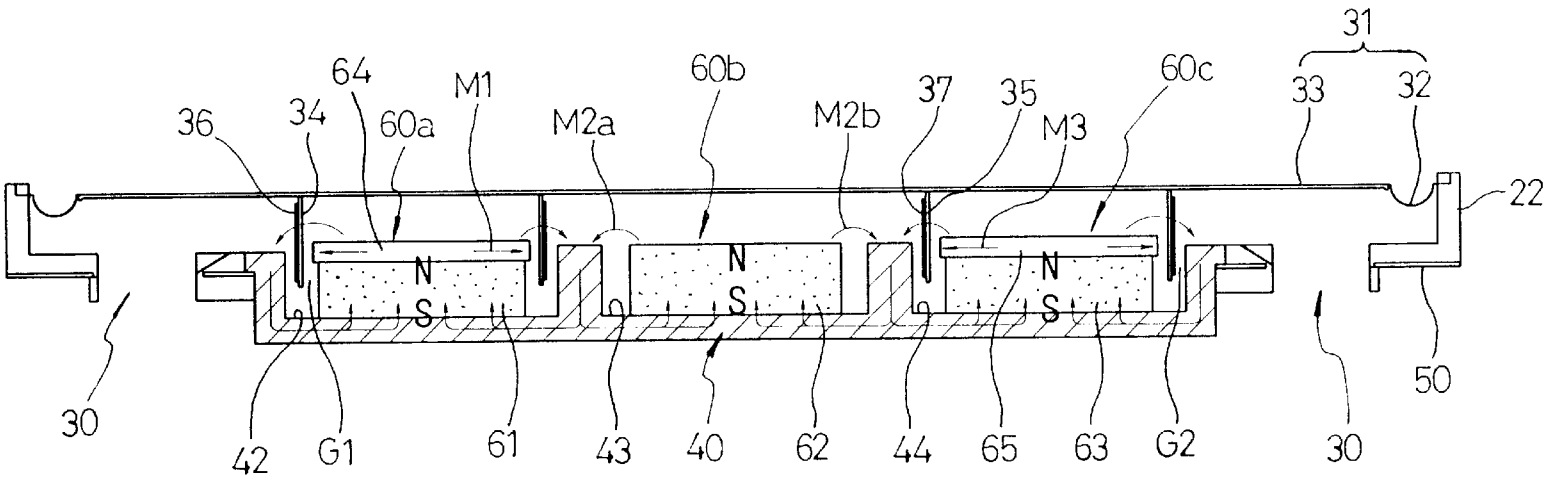
FIG. 6 is a sectional view of the oval-type mini-speaker according to the first embodiment, which is for describing the operation of the speaker.

FIG. 6 shows three disc-shaped permanent magnets 61 to 63 disposed respectively in each of the three recesses 42 to 44. On the permanent magnets 61 to 63 forming magnetic gaps G1 and G2 are fixed disc-shaped plates 64 and 65 for concentrating the magnetic flux of the magnets on the magnetic gaps to improve transducing efficiency. The yoke 40 and the plates 64 and 65 are made from magnetic-path-forming material.

In the meantime, upper ends of two bobbins 34 and 35 respectively having voice coils 36 and 37 wound thereon are fixed to the lower surface of a plane vibrational diaphragm 31 in such a manner that the bobbins 34 and 35 are respectively disposed in the gaps G1 and G2.

In this case, the vibrational diaphragm 31 comprises a body 33 of a substantially rectangular shape and a down roll type edge 32 for mounting the body 33 on the stepped portion 22*b* of the frame 22.

Material available for the body 33 may be a high molecular substance including a polyethylene(PE), a PET, a poly carbonate (PC), a polyethyleneimide (PEI), a polyimide (PI), a capton, or metal materials of reverse-magnetism or anti-magnetism series, i.e., a titanium (Ti), an aluminium (Al), a duralumin, a stainless steel, a brass and a phospor bronze.

The edge 22 may have various sectional shapes such as an up roll type, a plane shape, a wave type, etc., besides the shape of a down roll type described above. Also, the edge 22 may be a gasket-integrated type having a damping function, and may be made from silicon, high molecular resin, fiber, rubber, etc.

In this case, the body 33 and the edge 32 of the vibrational diaphragm 31, having a rectangular contour, may be separately made to be assembled with each other, or be made as one integral body. Further, rubber or a gasket 38 for fixing the edge 32 may be employed.

The above two voice coils 36 and 37 may constitute a circuit by a parallel or series connection for impedance matching. It is preferred that signals in the same direction are applied by using coils wound in the same winding direction so that the same driving signals such as voice signals may be applied in the same phase. When the adverse phases are applied to the two coils 36 and 37, the phase difference disturbs the balance of the vibration between right and left sides of the vibrational diaphragm 31, thereby eliminating low-pitch tone and degrading the function of the vibrational diaphragm.

The electrode patterns 51 and 52 of electric conductive metal formed on the PCB 50 have electrode pads 51*a*, 51*b*, 52*a*, and 52*b* pair by pair at either side thereof, and the electrode pads 51*a* and 52*a* are respectively connected to the electrode pads 51*b* and 52*b* respectively through connecting portions 51*c* and 52*c*. Therefore, the parallel connection of the voice coils 36 and 37 is achieved, when the two redundant leads 54*a* and 54*b* drawn out from the first coil 36 are respectively connected to the electrode pads 51*a* and 51*b* at one side and the two redundant leads 55*a* and 55*b* drawn out from the second coil 37 are respectively connected to the electrode pads 52*a* and 52*b* at the other side, by a proper method such as soldering.

In the meantime, when the redundant leads 54*a*, 54*b*, 55*a*, and 55*b* of the coils 36 and 37 are connected to the electrode pads 51*a*, 51*b*, 52*a*, and 52*b* of the PCB 50, each pair of redundant leads 54*a* and 54*b*, and 55*a* and 55*b* respectively drawn out from the coils 36 and 37 is twisted into one strand, so that the two pairs become two single strands of the redundant leads 54 and 55 pair by pair.

Thereafter, one end of each of the twisted redundant leads 54 and 55 is fixed to each of the bobbins 34 and 35 by an adhesive, and the redundant leads 54 and 55 are inserted along the two protruding guides 24*a* and 24*b* of zigzag shapes disposed in the penetrating space 23 formed in the bottom 22*a* of the frame 22. Then, the other ends of the redundant leads 54 and 55 are fixed to portions of the PCB(50) adjacent to the electrode pads 51*a*, 52*a*, 51*b* and 52*b* also by an adhesive. In this case, it is preferred that the adhesive may be made from material of a type which hardens after being applied.

Thereafter, the guides 24*a* and 24*b* are eliminated by cutting, and the penetrating space 23 surrounding the zigzag portions of the redundant leads 54 and 55 is filled with molding material 26 which maintains its softness even after being applied.

In result, any kinds of vibrations of the vibrational diaphragm 33 in upward and downward or leftward and rightward directions can not cut middle portions of the redundant leads 54 and 55 which flexibly respond with elasticity to the vibrations. Therefore, the speaker of the present invention can receive relatively high input compared with the prior art having limited input due to the possibility of cutting of the coils, which means the speaker of the invention can have a characteristic of high power.

To the stepped portion 22*b* of the frame may be fixed a periphery of a protector having a plurality of circular sound-passing holes in such a manner that the protector is even with the top of the frame. In general, the protector is omitted.

Figure 7A:
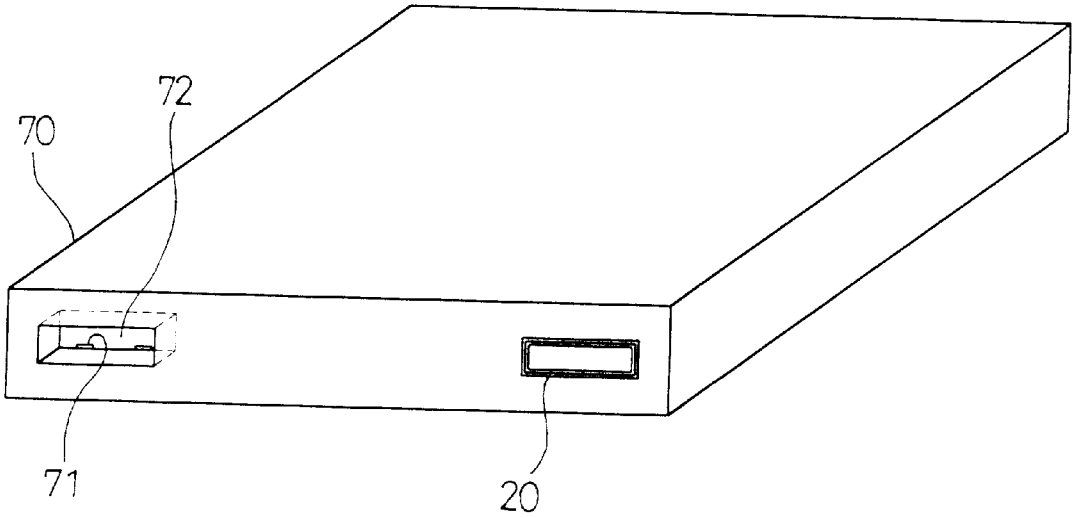
FIGS. 7*a* and 7*b* are perspective and sectional views for showing engaging grooves which are respectively assembled by snap engagement with snap engagement protuberances formed in a speaker-receiving hole of a casing, according to the invention.
Figure 7B:
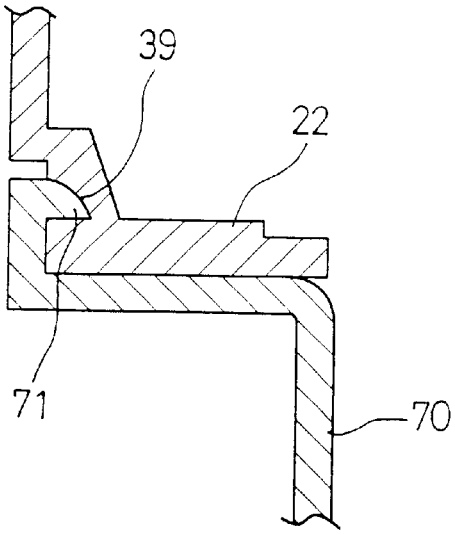

Meanwhile, the oval-type mini-speaker of the present embodiment includes four engaging grooves 39 formed at the four corners of the rear surface (the lower surface) of the frame 22 as shown in FIGS. 7*a* and 7*b*, which are respectively assembled by snap engagement with the four snap engagement protuberances 71 formed in a speaker-receiving hole 72 of a casing 70.

Therefore, the speaker 20 of the invention is automatically mounted in the casing 70 by a snap engagement between the snap engagement protuberances 71 and the engaging grooves 39 when it is pushed into the speaker-receiving hole 72.

B. Modification of the First Embodiment

Figure 8A:
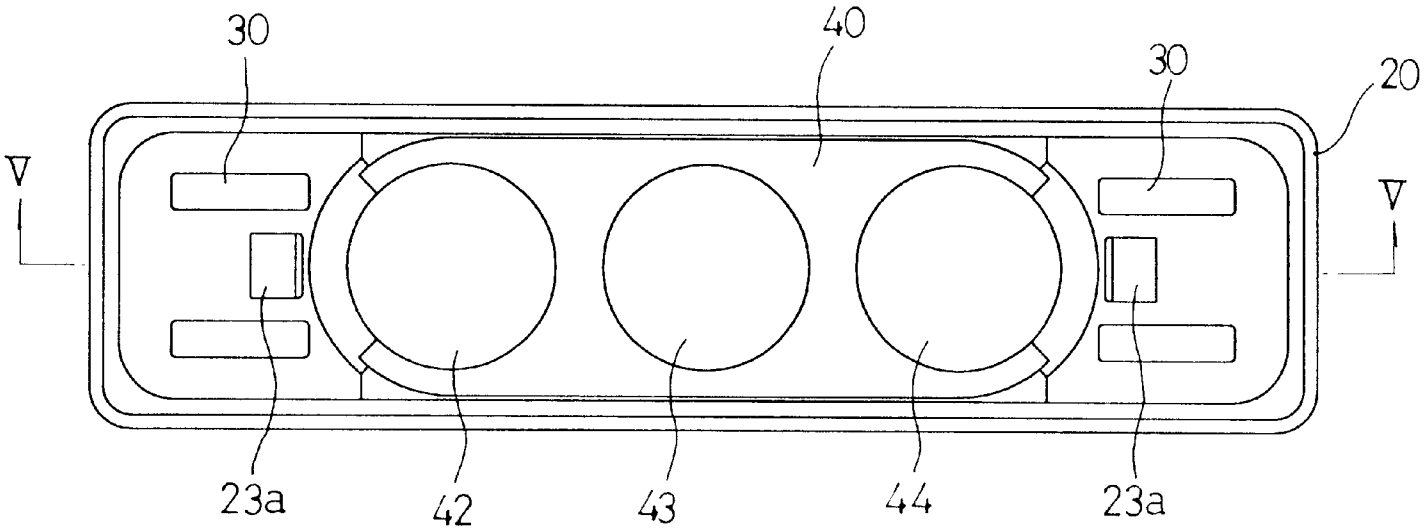
FIG. 8*a* is a plan view of an oval-type mini-speaker having a modified construction for fixing coils from the first embodiment of the present invention.
Figure 8B:
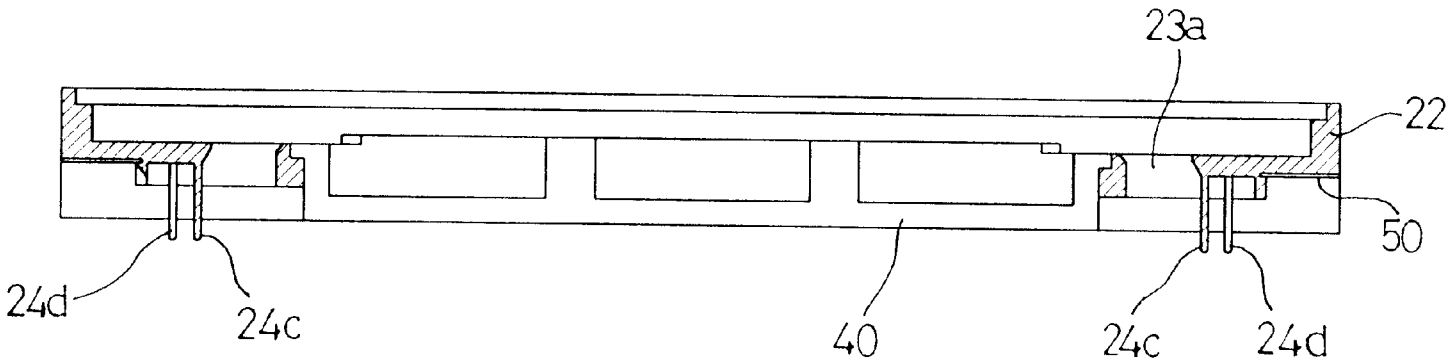
FIG. 8*b* is a sectional view along the line V—V in FIG. 8*a;*
Figure 8C:
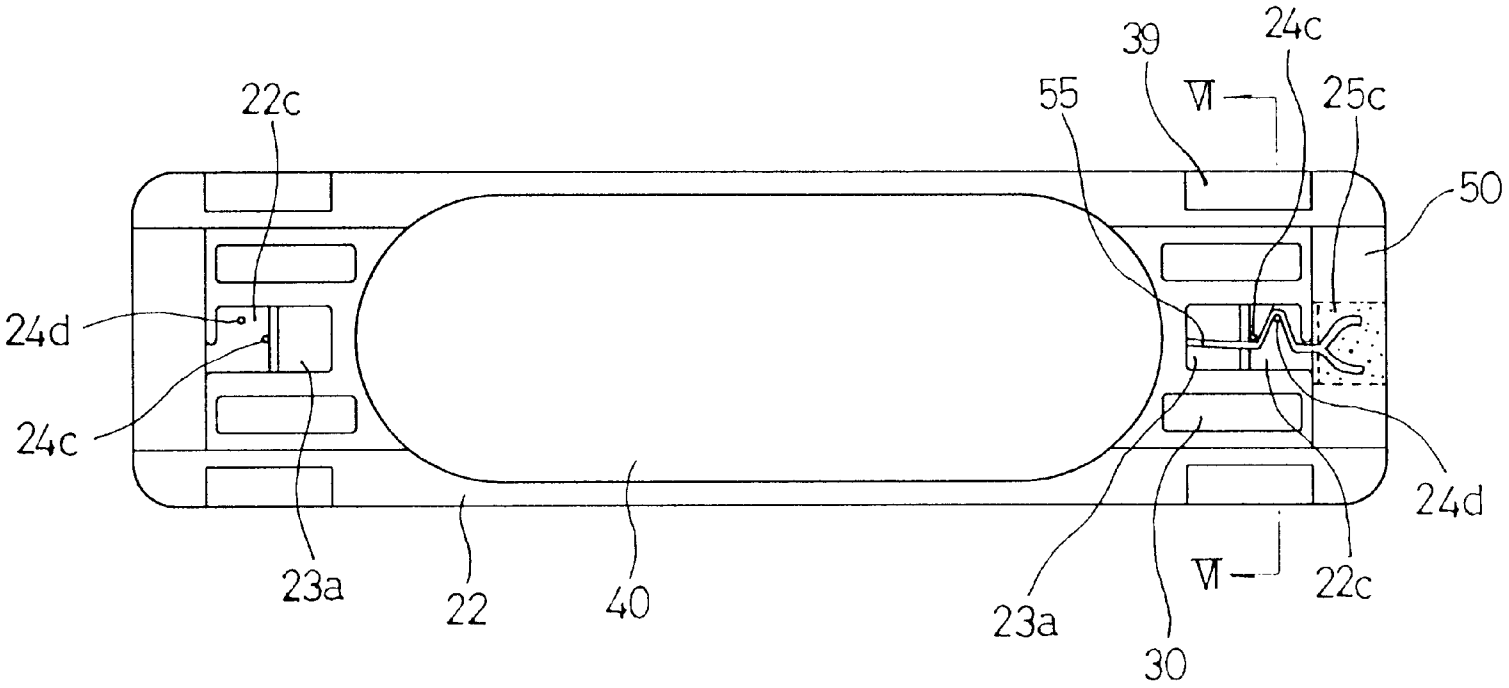
FIG. 8*c* is a bottom view of the oval-type mini-speaker shown in FIG. 8*a;*
Figure 8D:
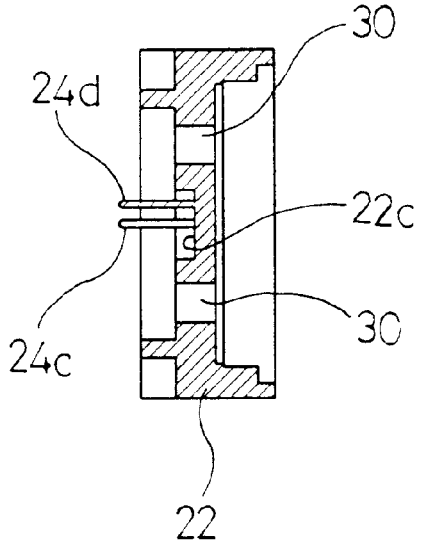
FIG. 8*d* is a sectional view along the line VI—VI in FIG. 8*c;*
Figure 8E:
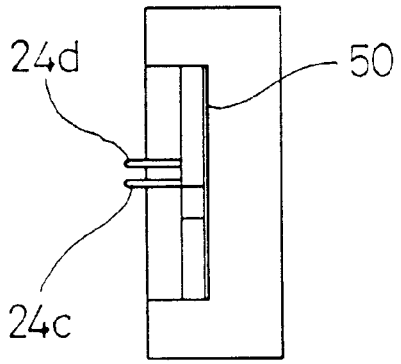
FIG. 8*e* is a right side elevation of the mini-speaker shown in FIG. 8*c;*

FIGS. 8*a* to 8*e* show a modification of the coil-fixing construction according to the first embodiment. FIG. 8*a* is a plane view of an oval-type mini-speaker having a modified coil-fixing construction, in which the frame, the yoke and the PCB are integrally formed by an insert injection molding. FIG. 8*b* is a sectional view taken along line V—V in FIG. 8*a*, FIG. 8*c* is a bottom view of the speaker shown in FIG. 8*a*, FIG. 8*d* is a sectional view taken along line VI—VI in FIG. 8*c*, and FIG. 8*e* is a right side elevation of the speaker shown in FIG. 8*c*.

In this modification, the constructions of the penetrating space 23 and guides 24*a* and 24*b* are changed, so that the penetrating space 23*a* has a reduced dimension by a half, and instead a stand 22*c* even with the PCB 50 is integrally formed with the frame 22 at the reduced portion that the space had originally occupied. In addition, the guides 24*c* and 24*d* protrude at a right angle to the stand 22*c*.

Accordingly, when the redundant lead 55 of the coil is fixed to the electrode pad of the PCB 50 in a similar way to the first embodiment, the redundant lead 55 is disposed in a zigzag shape by means of the guides 24*c* and 24*d* and the opposite ends thereof are fixed by an adhesive. Then, the guides 24*c* and 24*d* can be eliminated by hand without using a separate tool.

Thereafter, the middle portion of the redundant lead 55 is molded by the soft molding material, so that a more stable construction is achieved due to the support by the stand 22*c*.

Figure 9A:
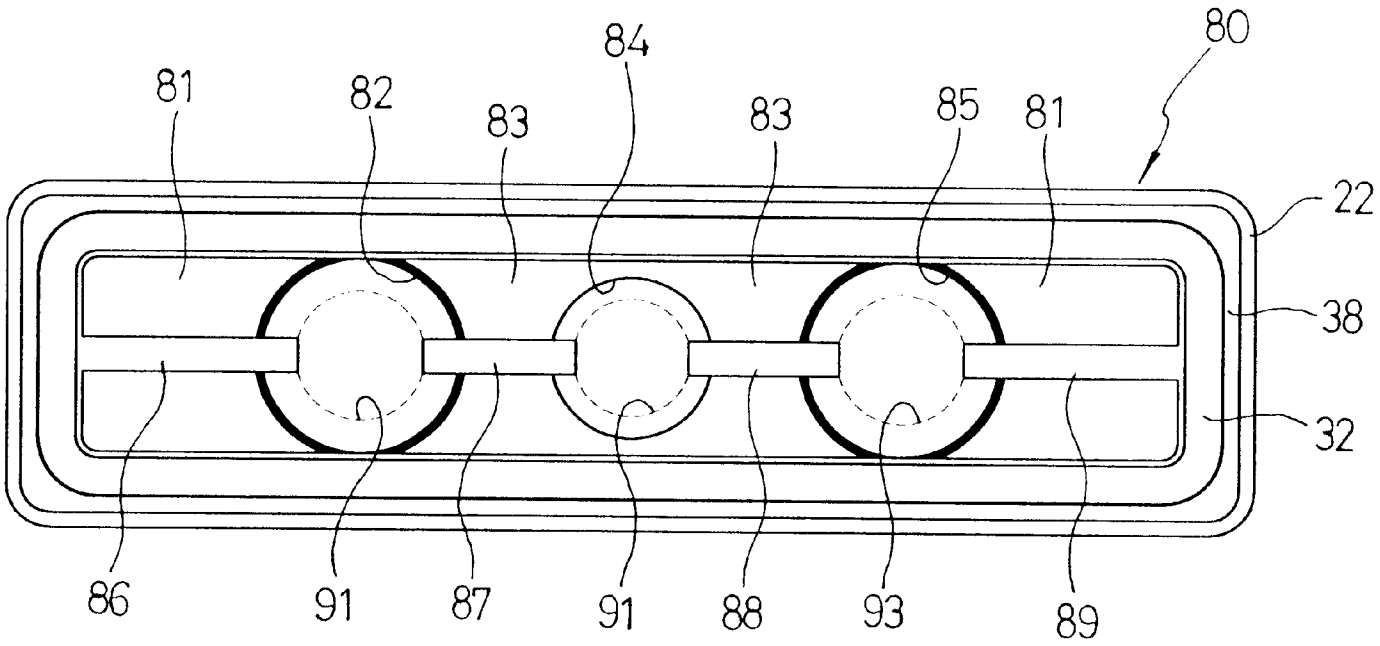
FIG. 9*a* is a plan view of an oval-type mini-speaker having a vibrating diaphragm provided with a plurality of ribs for preventing divisional resonance according to the second embodiment of the present invention.
Figure 9B:
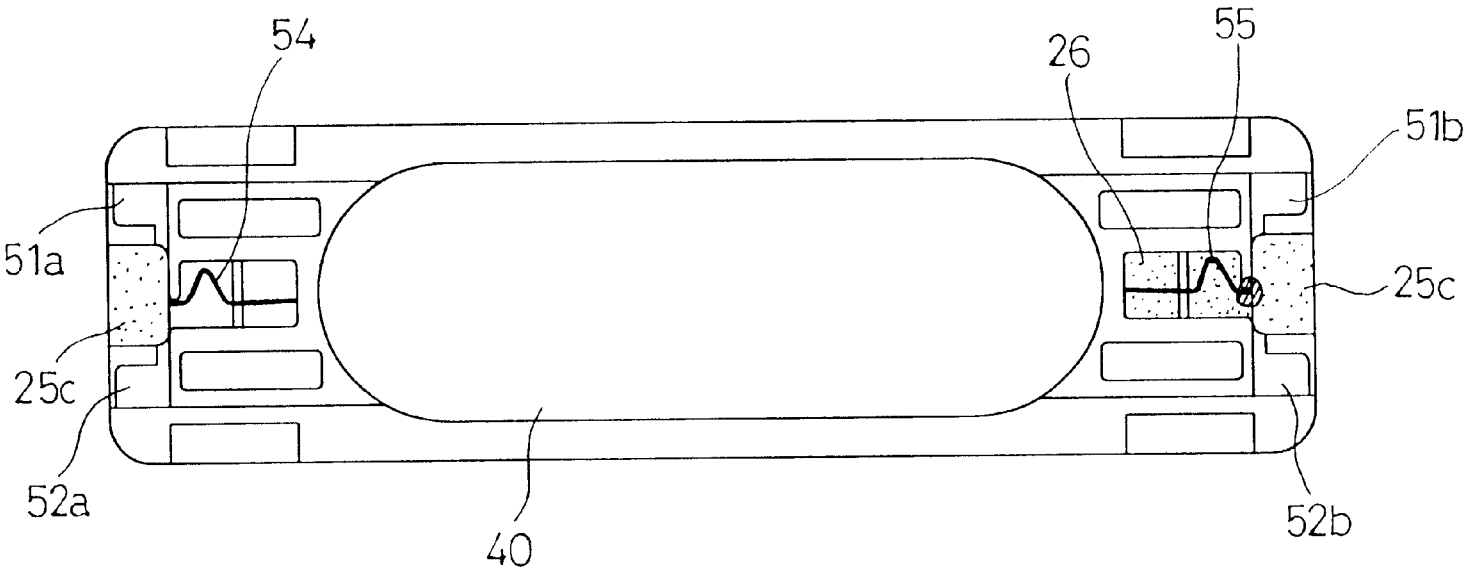
FIG. 9*b* is a bottom view of the oval-type mini-speaker shown in FIG. 9*a;*

Then, two free ends of the redundant lead 55 are fixed to a pair of electrode pads 51*a* and 52*a* or 51*b* and 52*b* at the right side of the PCB 50 by soldering and coated by molding material 25*c* for protection, so that fixing of the coil is completed as shown in FIG. 9*b*.

A detailed description of the operation principle and functions by the speaker according to the first embodiment of the present invention will be given hereinafter.

C. Principle of Electric-Acoustic Transduction and Wide Band Configuration

As shown in FIG. 6, the speaker according to the first embodiment of the invention includes first to third magnetic circuits 60*a* to 60*c* formed in a single yoke 40. The first and the second coils 36 and 37 are respectively received in the magnetic gaps G1 and G2 respectively of the first and the third magnetic circuits 60*a* and 60*c* disposed at the left and the right sides, so that the two circuits constitute dual voice coil drivers. The second magnetic circuit 60*b* disposed at the middle of them functions as an auxiliary magnetic circuit for generating auxiliary magnetic fields M2*a* and M2*b* which reinforce direct current magnetic fields M1 and M3 of the first and the third magnetic circuits 60*a* and 60*c*.

In other words, each S magnetic pole of the first to the third permanent magnets 61 to 63 of the first to the third magnetic circuits 60*a* and 60*c* are fixed to the yoke 40 so that the magnetic poles are arranged in the same direction. Then, formed are magnetic circuits according to the directions indicated by arrows shown in FIG. 6, in which the second magnetic circuit 60*b* generates auxiliary magnetic fields M2*a* and M2*b* respectively for reinforcing the magnetic fields of the first magnetic circuit 60*a* and the second magnetic circuit 60*b*.

Further, sinusoidal driving signals supplied from the exterior or the system employing the speaker are applied without phase difference to the first and the second coils 36 and 37 connected in parallel through electrode pads 51*a*, 51*b*, 52*a*, and 52*b* of the PCB 50, thereby generating two alternating rotational magnetic fields.

Therefore, Fleming's left-hand rule is applied between the first and the second coils 36 and 37 and the first and the third magnetic circuits 60*a* and 60*c*, so as to displace the coils up and down. Accordingly, the vibrational diaphragm 33 integrated with the coils vibrates to thereby produce compressional waves of air which generate sound.

In the first embodiment as described above, since a single speaker unit includes two magnetic circuits 60*a* and 60*c* and an auxiliary magnetic circuit 60*b* for increasing the direct magnetic flux, the speaker can have a transducing efficiency of a high value not only sufficient to compensate the reduction by the addition of one coil, but more significantly increased.

In result, the conventional micro-speaker reveals eighty dB of sound pressure level while seventy-five dB of sound pressure level has been measured as the maximum value by the conventional micro-speaker, under a circumstance that an input of one watt at a distance of one meter is applied. Therefore, the micro-speaker of the invention exhibits an improved transducing efficiency and a sound pressure level increased more than twice in comparison with the prior art.

In the meantime, the speaker of the first embodiment having two coils has an increased weight compared with the conventional speaker having a single coil, by the weight of one coil. This increase of weight is accompanied with the increase of the equivalent mass mo, which causes decrease of the low band resonance frequency $f_0$ in inverse proportion, since the low-sound resonance frequency or the low band resonance frequency $f_0$ is determined by the following Equation 1:

$$f_0 = \frac{1}{2\pi}\sqrt{\frac{so}{mo}} \quad \text{[Equation 1]}$$

In Equation 1, "so" represents stiffness which is an inverse of the compliance of the edge 112, and "mo" represents the equivalent mass of the vibrating system expressed by the sum of the weight of the coils 36 and 37, half the weight of the edge 32, the weight of the body 33, and an additional mass resulting from a reaction of air ($8/3\times 1.23\times a^3$ (Kg)), in which "a" represents a radius of a vibrational diaphragm. A reduced value of stiffness corresponds to an increase in compliance.

In general, the shorter the longer axis of the vibrational diaphragm is, the more advantageous it is to reproduce high pitch tone by the vibrational diaphragm. In the speaker of the present invention employing dual drivers of the first and the second magnetic circuits 60*a* and 60*b*, the length of the longer axis from each driver to the edge is relatively shorter in comparison with that in the conventional speaker. This means that the speaker of the present invention is relatively superior in reproducing sound of a high pitch tone.

Further, in the speaker of the present invention, the effective vibrating area is increased in spite of the decrease of the length of the longer axis, since it comes to correspond 20 to the entire area of the vibrational diaphragm due to the employment of the dual drivers. Accordingly, the speaker of the present invention reveals a relatively superior characteristic also in reproducing sound of a low pitch tone.

Therefore, the speaker of the present invention has expanded high-sound and low-sound bands, because its low band resonance frequency $f_0$ is decreased and its high band resonance frequency fh is increased.

In the case that a speaker unit of the present invention is configured to have a longer axis of 50 mm, a shorter axis of 13 mm, and a height of 4.1 mm, it has been confirmed that its reproducing frequency band measured in the free field of sound covers from 200 Hz to 16 KHz.

Therefore, the speaker of the present invention has all the frequency characteristics required by the micro-speaker, the receiver, and the buzzer.

D. Reduction of Second and Third Harmonic Distortions

In the case that an elliptic or oval vibration diaphragm is driven by a single driver unit or a single magnetic circuit, accordingly as the frequency increases, the vibration diaphragm comes to experience more of partial vibration or divisional vibration at either side of the vibration diaphragm, thereby generating nonlinear distortion of the vibrating system.

It is preferred to reduce this nonlinear distortion as much as possible, because it influences the second harmonic distortion deciding the purity of the reproduced sound.

In the speaker of the invention, since dynamic phase signals are applied to the two coils 36 and 37 and its operation is performed by two drivers having symmetric constructions, the second harmonic distortion is reduced to make the reproduced sound pure.

Meanwhile, in the case that the direct magnetic flux in the permanent magnet is smaller than the rotational magnetic field of the coils, the linearity of the direct magnetic flux flowing to the yoke is distorted. This phenomenon generates the third harmonic distortion having an influence on the tone color of the reproduced sound.

In the speaker of the present invention, the auxiliary magnetic fields M2*a* and M2*b* of the auxiliary magnetic circuit 60*b* respectively reinforce direct current magnetic fields M1 and M3 of the first and the third magnetic circuits 60*a* and 60*c*, so that the direct magnetic flux is relatively increased in comparison with the prior art, to thereby reduce the third harmonic distortion. This enables a reproduction of sound having a tone color nearer to that of the original sound.

E. Prevention of Breaking of Coil and High Input Receiving Configuration

Since conventional electrodynamic type speakers are configured such that a coil vibrates directly to produce a sound, i.e., a coil wire connected to a terminal plate of a PCB along a body of a vibrational diaphragm from a coil moves along according to a displacement of the vibrational diaphragm, it cannot receive an input, especially when a high input is applied thereto, due to a possible breaking of the coil wire for supplying an electric signal to the coil.

On the other hand, in the micro-speaker of the present invention, the redundant leads 54 and 55 drawn from the coils 36 and 37 are not fixed to the body of the vibrational diaphragm, but instead are inserted in zigzag shapes through the penetrating space 23 with each having a sufficient length for the vibration. Moreover, soft molding material is filled in the penetrating space 23, and the opposite ends of the coils are fixed to the bobbins 34 and 35 and the PCB 50 by firm adhesives 25*a* and 25*b*.

Accordingly, the redundant leads 54 and 55 of the coils can flexibly correspond to any kinds of vibrations in up and down or rightward and leftward directions, and thereby are prevented from breaking due to the vibrations.

Further, the yoke of the invention includes stepped portions 45 formed by eliminating the opposite side portions of the yoke with a certain width and a height of about 0.3 to about 0.5 mm in the longitudinal direction of the yoke 40 from the upper ends of the first and the third recesses 42 and 44 receiving the coils 36 and 37. Therefore, the limitation of the width in which the coil can vibrate is increased by the above height, thereby increasing the allowable input.

In other words, the speaker of the present invention is not restricted by a limitation of allowable input due to the breaking of the coils, but can exhibit a characteristic of high output because it can receive a high input by receiving divisional input signals through two coils 36 and 37 connected in parallel.

In result, the present invention enables even an ultra micro-speaker having a dimension of a longer axis of 13 mm, a shorter axis of 50 mm, and a height of 4.1 mm, to receive a high rated input of 2 W.

F. Automatically Mounting Construction

Further to the functions of the broad band reproduction and the high input, the speaker of the present invention has a function which enables the automatic mounting by a snap engagement without soldering as shown in FIGS. 7*a* and 7*b*.

G. Second Embodiment

Figure 9C:
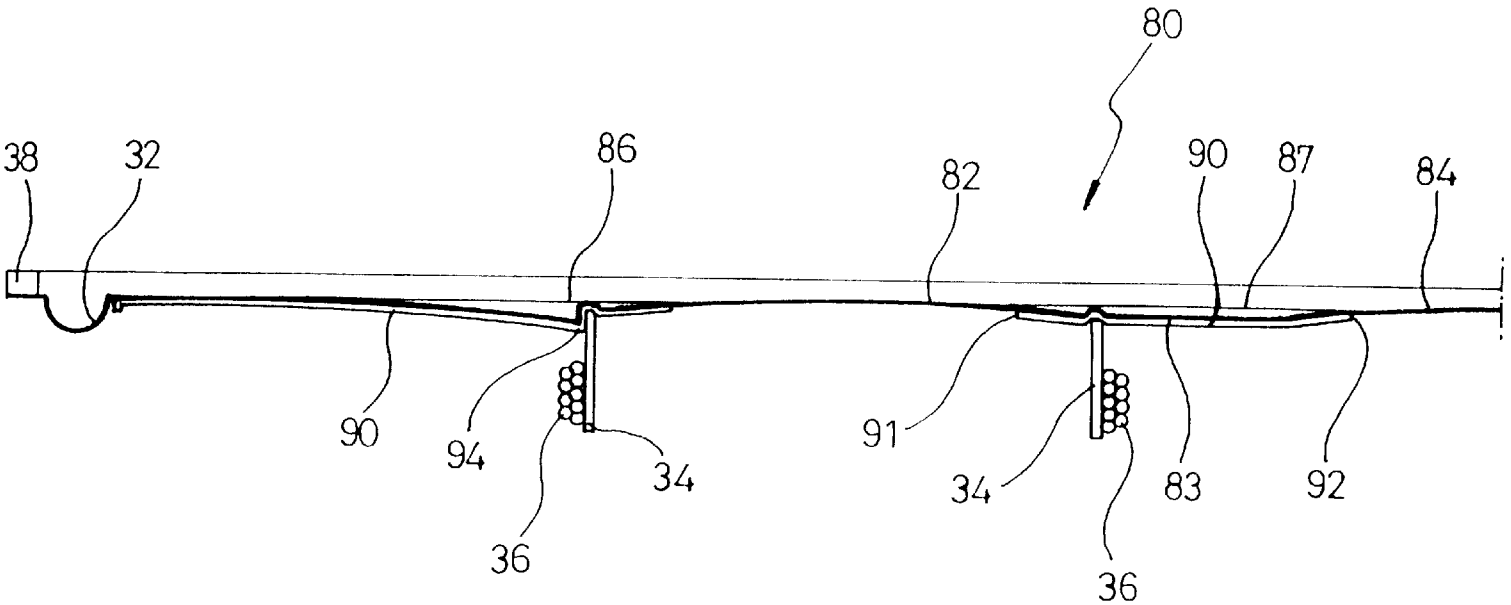
FIG. 9*c* is an enlarged sectional view of the vibrating diaphragm shown in FIG. 9*a;*

Hereinafter, described will be an oval-type micro-speaker having a vibrational diaphragm provided with ribs for preventing divisional resonance, according to the second embodiment of the present invention, as shown in FIGS. 9*a* to 9*c*.

FIGS. 9*a* and 9*b* are respectively plan and bottom views of the micro-speaker according to the second embodiment of the present invention, and FIG. 9*c* is an enlarged sectional view of the vibrational diaphragm shown in FIG. 9*a*. In the micro-speaker according to the second embodiment as shown, the vibrational diaphragm 80 includes an edge 32, bodies 81 and 83, and first to third dust caps 82, 84 and 85 integrally formed altogether. Four ribs 86 to 89 for preventing divisional resonance are arranged at regular intervals along the center line in the longitudinal direction of the vibrational diaphragm 80. At every space between the four ribs 86 to 89 are disposed the first to the third dust caps 82, 84 and 85 one by one in sequence. It is preferred that the four ribs 86 are made from a high molecular film material having a superior restoring force.

Further, under the vibrational diaphragm 80, reinforcing bodies 90 respectively having openings 91 to 93 are attached to the middle portions of the first to the third dust caps 82, 84, and 85. The reinforcing bodies 90 respectively have the same shape with that of the integrated vibrational diaphragm 80 excepting the edge, and are made from a hard and light material such as an aluminum Al, a titanium Ti, a duralumin, a pulp, a high molecular material and so on, so as to reduce the nonlinear distortion.

As shown in FIG. 9*c*, the bodies 81 at the left and the right sides of the integrated vibrational diaphragm 80 respectively have a cone shape, and the body at the center thereof has a flat shape. The first to the third dust caps 82, 84, and 85 respectively have a dome shape, and the four ribs 86 to 89 have the same level from the inner periphery of the down roll type edge 32 to the openings 91 to 93 and protrude beyond the bodies 81 and 83 with a constant width.

Further, bobbins 34 and 35 on which coils 36 and 37 are wound are fixed to the neck 94 of the vibrational diaphragm 80 and reinforcing bodies 90, that is, to the border portion of the bodies 81 and 83 and the caps 82, 84 and 85.

In the micro-speaker of the second embodiment as described above, the four ribs 86 to 89 disposed along the longitudinal axis of the entire bodies 81 and 83 of the vibrational diaphragm 80 miniaturizes the mechanical deflection of the bodies 81 and 83 along the entire vibrational diaphragm 80. In result, a piston-sinusoidal vibration together with dual drivers is realized in the range of a low pitch tone, and the divisional resonance is regulated in the range of middle and high pitch tones.

Accordingly, the second embodiment of the present invention realizes a speaker having a frequency characteristic constant or plane over the entire reproducible frequency bands. Moreover, the restriction of the divisional resonance highly decreases the second harmonic components, to thereby enable a clean and clear reproduction of sound.

In the speaker of the second embodiment as shown in the drawings, the reinforcing bodies 90 for reinforcing the vibrational diaphragm may be excluded by employing an integrated vibrational diaphragm 80 without the reinforcing bodies 90.

A description of the construction and the operation of the frame 22 and the yoke 40 are omitted because they are the same as those in the first embodiment.

The speaker of the second embodiment may have the same dimension with that of the first embodiment, and in this case the former exhibits superior reproduction characteristics over the entire bands, higher input/output and superior characteristic of high efficiency, according to the modification of the vibrational diaphragm.

H. Third Embodiment

Figure 10:
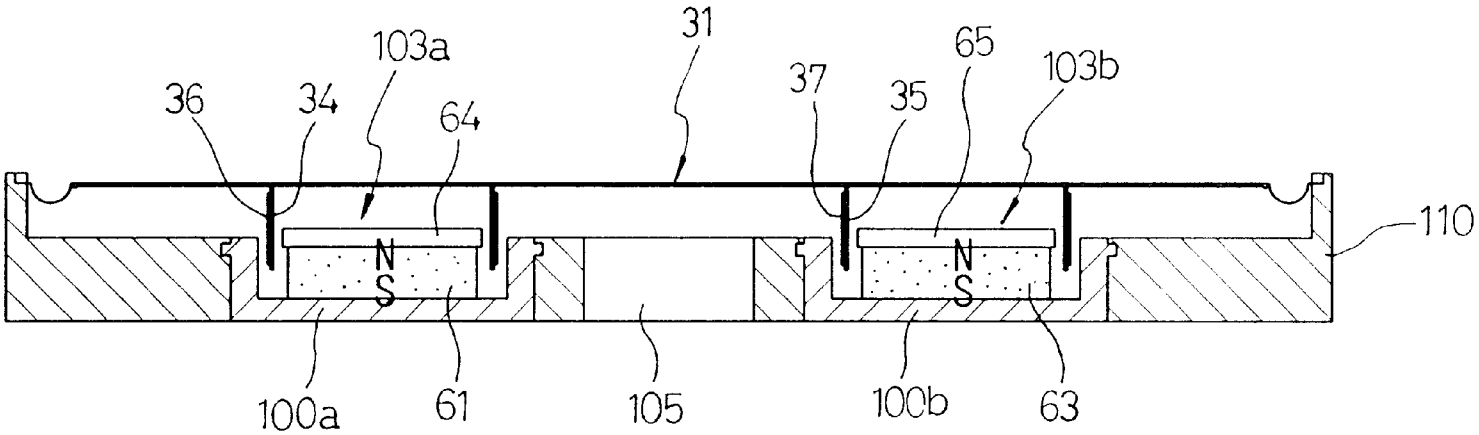
FIG. 10 is a sectional view of an oval-type mini-speaker having independent dual sound-sources according to the third embodiment of the present invention.

FIG. 10 shows an oval-type micro-speaker having independent dual sound-source constructions or drivers, according to the third embodiment of the present invention.

As shown, differently from that of the first embodiment, the oval-type micro-speaker includes first and second yokes 100*a* and 100*b* separately inserted in the frame 110 having an air vent 105 formed between the yoke receiving portions. In the drawings showing the third embodiment, the same numerals are given to the same parts as those in the first embodiment.

In the third embodiment, the vibrational diaphragm 31 to which dual voice coils 36 and 37 are attached may employ the same construction as that in the first embodiment or a construction modified from that in the second embodiment.

Further, the permanent magnets 61 and 63 and the magnetic flux concentrating plates 64 and 65 are received in the first and the second yokes 100*a* and 100*b*, so that they constitute the first and the second magnetic circuits 103*a* and 103*b* as the dual drivers for driving the coils 36 and 37. The same magnetic poles, for example S poles, of the permanent magnets 61 and 63 are attached to the recesses of the yokes 100*a* and 100*b*, and the coils 36 and 37 are connected in parallel.

Therefore, the speaker of the third embodiment exhibits a similar effect to that of the first embodiment on the same condition, since it has similar dual drivers to those of the first embodiment.

I. Fourth Embodiment

Figure 11:
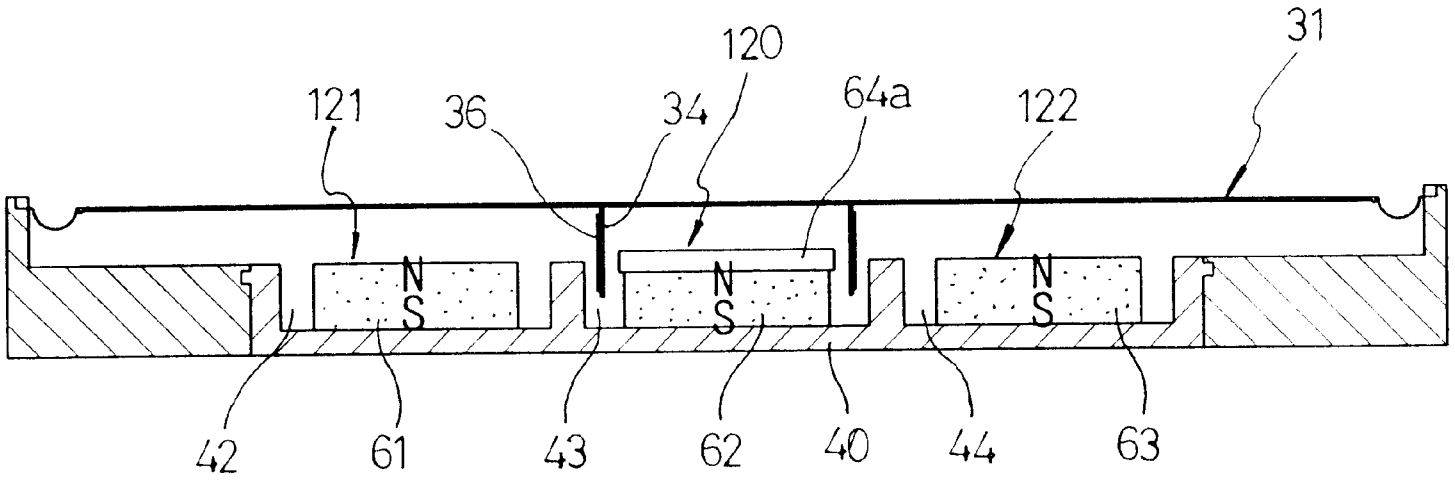
FIG. 11 is a sectional view of an oval-type mini-speaker having a single sound-source and dual auxiliary magnetic circuits according to the fourth embodiment of the present invention.

FIG. 11 shows an oval-type micro-speaker having a single sound-source and dual auxiliary magnetic circuits, according to the fourth embodiment of the present invention.

In the drawings showing the fourth embodiment, the same numerals are given to the same parts as those in the first embodiment, the description of which is omitted, and the difference will be described hereinbelow.

In the fourth embodiment as shown, differently from that of the first embodiment, a single magnetic circuit 120 as the coil-driving driver is formed in the middle recess 43 of the yoke 40, while first and second auxiliary magnetic circuits 121 and 122 are formed in the left and the right recesses 42 and 44 of the yoke 40.

The single magnetic circuit 120 has a construction in which a permanent magnet 62 and a plate 64*a* are received in the middle recess 43 of the yoke 40, which is the same as the construction of the first and the second magnetic circuits 60*a* and 60*c* in the first embodiment. The first and the second auxiliary magnetic circuits 121 and 122 have a construction in which the permanent magnets 61 and 63 are respectively received in the left and the right recesses 42 and 44, which is the same as the construction of the auxiliary magnetic circuit 60*b* in the first embodiment.

Also, in the fourth embodiment, the vibrational diaphragm 31 may be the same as that in the first embodiment, or may be modified to have the reinforcing ribs and the reinforcing bodies of the second embodiment. In the fourth embodiment, a single coil 36 is wound on a single bobbin 34 corresponding to the single magnetic circuit 120.

In the fourth embodiment, the dual auxiliary magnetic circuits 121 and 122 provided at either side thereof reinforce the magnetic flux of the main magnetic circuit 120. Therefore, the speaker of the fourth embodiment exhibits a high transducing efficiency or a high sound pressure level (SPL), since it has a sufficiently reinforced vibrational force in comparison with the conventional micro-speaker having a single magnetic circuit including the coil 36 and the vibrational diaphragm 31.

Although the first and the second coils are connected in parallel in consideration of impedance matching in the above embodiments, they may be connected in series also.

In addition, although the above embodiments show a design of the frame such that the speaker unit has a light, thin, short, and small shape, the design may be applied to a large dimension having a high output with a high transducing efficiency.

The most principal concept of the present invention is to propose an improved construction in which a plurality of magnetic circuits with a plurality of magnetic gaps are fixedly received in a single yoke or a plurality of yokes and are arranged in series at a frame, so as to drive a plurality of coils. This technical concept may be adopted by any kinds of electric-acoustic transducers.

The micro-speaker of the present invention as described above may have the following characteristics and dimensions as a terminal for processing information: a reproduction frequency band of 200 Hz to 16 KHz; a longer axis of 13 mm, a shorter axis of 50 mm, and a height of 4.1 mm; a rated power of two watt; an output sound pressure level of 80 dB at a distance of one meter by an input of one watt; and a good assembling characteristic without using assembling screws.

As apparent from the above description, the present invention provides an ultra micro-speaker capable of receiving a high input, generating a high output, and reproducing a wide band frequency, with having a high efficiency. Therefore, the present invention realizes a single unit of a sound reproducing system without a separate micro-speaker, receiver and buzzer, to thereby reduce the number of entire parts employed in the sound reproducing system. Therefore, the present invention contributes to the development of portable electronic appliances having an improved sound reproducing capability.

Further, since the speaker of the present invention can be assembled with or mounted to the sound reproducing system by a simple forcing action, the present invention eliminates the complicated operation for fixing the speaker required in the conventional speaker.

While there have been illustrated and described what are considered to be preferred specific embodiments of the present invention, it will be understood by those skilled in the art that the present invention is not limited to the specific embodiments thereof, and various changes and modifications and equivalents may be substituted for elements thereof without departing from the true scope of the present invention.

What is claimed is:

1. An electric-acoustic transducer comprising:

a yoke having first to third recesses arranged in series at regular intervals;

first to third permanent magnets respectively received in the first to the third recesses, the first to the third permanent magnets being arranged in a same polar direction to generate non-alternating magnetic fields;

first and second plates respectively mounted on the first and the third permanent magnets to form first and second magnetic gaps between an upper end of the yoke and outer peripheries of the first and the second plates;

first and second coils respectively disposed in the first and the second magnetic gaps, the first and the second coils generating alternating magnetic fields of a same phase and being displaced up and down according to a cooperation with the non-alternating magnetic fields generated by the first to the third permanent magnets when an electric driving signal is applied from an exterior;

a rectangular frame having a periphery extending at a right angle to a remaining portion of the frame to form a recess, the yoke being placed at a center of the frame and surrounded by the periphery; and a vibrational diaphragm having a periphery supported by an upper end of the frame, the first and the second coils being attached to the vibrational diaphragm so that the vibrational diaphragm generates sound corresponding to the electric driving signal when the first and the second coils are displaced up and down.

2. An electric-acoustic transducer as claimed in claim 1, wherein the yoke for forming the first and the second magnetic gaps, the first and the third permanent magnets, and the first and the second plates form first and second magnetic circuits respectively for driving the first and the second coils, and the non-alternating magnetic flux generated from the second permanent magnet is added to the non-alternating magnetic fluxes of the adjacent first and the second magnetic circuits.

3. An electric-acoustic transducer as claimed in claim 1, wherein the frame further comprises:

first and second penetrating spaces formed at both sides out of the yoke and communicating with an interior of the recess of the frame;

first and second guide means for forming first and second redundant leads in zigzag shapes, the first and the second redundant leads being drawn out through the first and the second penetrating spaces from the first and the second coils;

electrode terminals, through which the driving signal is applied from the exterior, having first to fourth electrode pads printed on a lower surface of the frame at both sides of the first and the second penetrating spaces, the first and the second redundant leads having opposite ends connected to the first to the fourth electrode pads, the first and the second electrode pads at a first side of the frame being connected to the third and the fourth electrode pads at a second side of the frame to thereby connect the first and the second coils in parallel to each other; and soft molding materials filled in the first and the second penetrating spaces with surrounding the first and the second redundant leads, thereby preventing the first and the second redundant leads from breaking, wherein the first and the second guide means are eliminated after the first and the second redundant leads are fixedly connected to the first to the fourth electrode pads.

4. An electric-acoustic transducer as claimed in claim 1, wherein the vibrational diaphragm comprises a body having a shape of a rectangular plate and an edge for fixing the body to the frame.

5. An electric-acoustic transducer as claimed in claim 1, wherein the vibrational diaphragm comprises:

first and second portions extending laterally in cone shapes from the first and the second necks to which the first and the second coils are attached;

third to fifth portions respectively forming a dome shape in first to third dust caps, the first and the second dust caps being disposed in the first and the second necks, the third dust cap being placed on a second recess between the first and the second necks;

a sixth portion forming a plane surface between the first and the second necks;

a seventh portion for preventing a divisional resonance of the vibrational diaphragm at a range of middle and high pitch tones, the seventh portion discontinuously protruding with a constant width and a constant height along a center portion of the first to the sixth portions excepting a central portion of the first to the third dust caps; and an edge formed integrally with the first to seventh portions, a body including the first to the second portions being supported by the frame.

6. An electric-acoustic transducer as claimed in claim 5, further comprising a reinforcing body for reducing nonlinear distortion of the vibrational diaphragm, the reinforcing body having a shape equal to a shape formed by the first to the sixth portions and being attached to a lower surface of the vibrational diaphragm, the reinforcing body having openings corresponding to center portions of the first to the third dust caps.

7. An electric-acoustic transducer as claimed in claim 1, wherein the yoke comprises first to third recesses formed at regular intervals and stepped portions formed by eliminating side portions of the yoke with a constant width in a longitudinal direction of the yoke from upper ends of the first and the third recesses.

8. An electric-acoustic transducer as claimed in claim 1, further comprising first to fourth engaging grooves respectively formed at the four corners of the front surface of the frame, each of which is assembled by snap engagement with each of first to fourth snap engagement protuberances formed at a casing accommodating the speaker.

9. An electric-acoustic transducer comprising:

first and second yokes being spaced apart and respectively having first and second recesses;

first and second permanent magnets respectively received in the first and the second recesses, the first and the second permanent magnets being arranged in a same polar direction to generate non-alternating magnetic fields;

first and second plates respectively mounted on the first and the second permanent magnets to form first and second magnetic gaps between an upper end of the yoke and outer peripheries of the first and the second plates;

first and second coils respectively disposed in the first and the second magnetic gaps, the first and the second coils generating alternating magnetic fields of a same phase and being displaced up and down according to a cooperation with the non-alternating magnetic fields generated by the first and the second permanent magnets when an electric driving signal is applied from an exterior;

a rectangular frame having a periphery extending at a right angle to other portion of the frame to form a recess, the first and the second yokes being placed at spaced two middle positions of the frame and surrounded by the periphery; and a vibrational diaphragm having a periphery supported by an upper end of the frame, the first and the second coils being attached to the vibrational diaphragm so that the vibrational diaphragm generates sound corresponding to the electric driving signal when the first and the second coils are displaced up and down.

10. An electric-acoustic transducer as claimed in claim 9, further comprising a plurality of pores formed at a bottom of the frame to provide passages of sound and heat.

11. An electric-acoustic transducer comprising:

a yoke having first to third recesses arranged in series at regular intervals;

first to third permanent magnets respectively received in the first to the third recesses, the first to the third permanent magnets being arranged in a same polar direction to generate non-alternating magnetic fields;

a plate mounted on the second permanent magnet to form a magnetic gap between an upper end of the yoke and outer periphery of the plate;

a coil disposed in the magnetic gap, the coil generating an alternating magnetic field and being displaced up and down according to a cooperation with the non-alternating magnetic field generated by the second permanent magnet when an electric driving signal is applied from an exterior;

a rectangular frame having a periphery extending at a right angle to a remaining portion of the frame to form a recess, the yoke being placed at a center of the frame and surrounded by the periphery; and a vibrational diaphragm having a periphery supported by an upper end of the frame, the coil being attached to the vibrational diaphragm so that the vibrational diaphragm generates sound corresponding to the electric driving signal when the coil is displaced up and down.

12. An electric-acoustic transducer as claimed in claim 11, wherein the yoke for forming the magnetic gap, the second permanent magnet, and the plate form a first magnetic circuit for driving the coil, and the non-alternating magnetic fluxes generated from the first and the third permanent magnets are added to a non-alternating magnetic flux of the magnetic circuit.

* * * * *